US008869934B2

(12) United States Patent
Bodnar et al.

(10) Patent No.: US 8,869,934 B2
(45) Date of Patent: Oct. 28, 2014

(54) METHOD, APPARATUS, AND ARRANGEMENT FOR A LIFELINE SYSTEM

(75) Inventors: Jonathan Bodnar, Cheswick, PA (US); Zoe Bridges, Bala Cynwyd, PA (US); Nadeem Haidary, New Fairfield, CT (US); Jason Jura, Forest Hill, MD (US); Jung Hwan Park, Salem, MA (US); Ruqian Zhou, Pittsburgh, PA (US)

(73) Assignee: Mine Safety Appliances Company, LLC, Cranberry Township, PA (US)

( * ) Notice: Subject to any disclaimer, the term of this patent is extended or adjusted under 35 U.S.C. 154(b) by 882 days.

(21) Appl. No.: 12/631,996

(22) Filed: Dec. 7, 2009

(65) Prior Publication Data

US 2010/0294590 A1 Nov. 25, 2010

Related U.S. Application Data

(60) Provisional application No. 61/216,709, filed on May 20, 2009.

(51) Int. Cl.

| | |
|---|---|
| ***B61B 7/00*** | (2006.01) |
| ***A62B 35/00*** | (2006.01) |
| ***E04G 21/32*** | (2006.01) |

(52) U.S. Cl.

CPC ..... *A62B 35/0056* (2013.01); *A62B 35/0087* (2013.01); *E04G 21/3204* (2013.01)

USPC ..... 182/36; 182/3; 182/5; 104/112

(58) Field of Classification Search

CPC ..... A62B 35/0062; A62B 35/005; A62B 35/0043; A62B 35/0081; A62B 35/0087; A62B 35/0056; A62B 35/0068; E04G 21/3204

USPC ..... 104/112, 113, 114; 182/3, 5, 36

See application file for complete search history.

(56) References Cited

U.S. PATENT DOCUMENTS

| | | | | | |
|---|---|---|---|---|---|
| 4,699,245 | A | * | 10/1987 | Benedet | 182/3 |
| 4,790,410 | A | * | 12/1988 | Sharp et al. | 182/36 |
| 5,042,391 | A | * | 8/1991 | Kahl | 104/113 |
| 5,279,385 | A | * | 1/1994 | Riches et al. | 182/3 |
| 5,297,651 | A | * | 3/1994 | Vandelinde | 182/3 |
| 5,350,037 | A | * | 9/1994 | Ghahremani | 182/3 |
| 5,653,172 | A | * | 8/1997 | Roschier | 104/93 |
| 5,979,599 | A | * | 11/1999 | Noles | 182/36 |
| 6,467,574 | B2 | * | 10/2002 | Lara | 182/36 |

(Continued)

FOREIGN PATENT DOCUMENTS

| | | | |
|---|---|---|---|
| EP | 1900394 | A1 | 3/2008 |
| EP | 2145651 | A1 | 1/2010 |
| GB | 2370312 | A | 6/2002 |
| WO | WO 2009133361 | A1 | 5/2009 |

*Primary Examiner* — Alvin Chin-Shue
*Assistant Examiner* — Colleen M Chavchavadze
(74) *Attorney, Agent, or Firm* — The Webb Law Firm

(57) ABSTRACT

A shuttle member for a horizontal lifeline system having at least one elongate line attached between at least two anchorage points. The shuttle member includes: a body having: (i) an upper portion configured for attachment to the line by at least partially surrounding the line; (i) an intermediate portion that, together with the upper portion, defines at least one passage slit that is sized such that the elongate line cannot pass therethrough; and (iii) an attachment portion configured for attachment of at least a portion of a lanyard. A shuttle member arrangement and a passing method are also disclosed.

20 Claims, 5 Drawing Sheets

(56) References Cited

U.S. PATENT DOCUMENTS

| | | | | |
|---|---|---|---|---|
| 6,488,118 | B1 * | 12/2002 | Corriveau | 182/36 |
| 7,347,300 | B2 * | 3/2008 | Renton et al. | 182/36 |
| 8,001,904 | B2 * | 8/2011 | Maes et al. | 104/112 |
| 2002/0050421 | A1 * | 5/2002 | Lara | 182/36 |
| 2007/0119653 | A1 * | 5/2007 | Brown et al. | 182/36 |
| 2008/0135333 | A1 * | 6/2008 | Renton et al. | 182/36 |

* cited by examiner

METHOD, APPARATUS, AND ARRANGEMENT FOR A LIFELINE SYSTEM

BACKGROUND OF THE INVENTION

1. Field of the Invention

The present invention relates generally to fall protection systems and arrangements, and in particular to a method, apparatus and arrangement for use in connection with a lifeline system, preferably a horizontal lifeline system, and further to a shuttle member, a shuttle member arrangement, and a method of passing such shuttle members during use in such a lifeline system.

2. Description of the Related Art

In the construction industry, one of the most dangerous aspects is working at great heights above the ground, e.g., high-level buildings, repair of certain large structures, etc. The leading reason for injuries and fatalities within the construction industry is a fall from a high location. Such a dangerous situation and environment exists in many different industries and activities as well. Therefore, an important safety consideration is to protect the worker or other person operating or engaging in an activity at an elevated height.

In order to protect a person in the event of a fall situation, certain vertical and horizontal lifeline systems have been developed, and these systems can be permanent or temporary. Permanent systems are utilized when the activities either always occur at the same location, or at least for a long enough period to justify the permanent installation of the lifeline system. However, in certain other situations and environments, e.g., building a structure, a temporary lifeline system is setup, utilized at that level, and taken down for use as each particular portion of the structure is completed. Therefore, in many instances in the construction industry, a portable and temporary lifeline system is used.

One particular type of lifeline system that can be installed as a portable, temporary arrangement is a horizontal lifeline system that includes an elongate line, e.g., a cable or the like, attached between two anchor points and extending along a structure. In operation, the user will attach a shock-absorbing lanyard or a self-retracting lanyard to some attaching device, such as a shuttle member that is movable along the line. In the event of a fall, the lanyard and the elongate line will prevent the user from falling to the ground. Further, and in most situations, multiple workers will be attached to the same line using their own separate and distinct attaching device.

Again, while certain permanent solutions exist, a portable, temporary horizontal lifeline system is often preferable, based at least in part upon the following: (1) the time savings realized in installing and taking down a temporary system; (2) the ease and convenience of installation and removal of a temporary system; and (3) the ease of manipulating and operating a temporary system at elevated positions and heights. However, as stated, in existing systems, more than one worker is often attached to a single lifeline, which leads to the need for workers to pass each other. In present arrangements, both workers typically must move to one end of the lifeline system, each respectively remove their attaching device and connect it to a temporary anchor point, and then re-attach the devices in the preferred order to allow the workers to "pass" each other. This obviously leads to increased time, decreased efficiency, and a greater possibility of some mishap when the workers are making the switch.

Therefore, there exists a need in the art for a lifeline system that allows for the safe passing of multiple attaching devices connected to a single line or cable in the system. Further, there remains a need in the art for methods, devices, and arrangements that improve user safety without sacrificing efficiency or effectiveness.

SUMMARY OF THE INVENTION

Generally, the present invention provides methods, apparatus and arrangements for a lifeline system that overcome some or all of the drawbacks and deficiencies existing in known systems. Preferably, the present invention provides methods, apparatus and arrangements for a lifeline system that permit the safe passage of multiple attaching devices connected to the same line or cable. Preferably, the present invention provides methods, apparatus and arrangements for a lifeline system that lead to increased safety, and are easy to implement and utilize. Preferably, the present invention provides methods, apparatus and arrangements for a lifeline system that are useful in connection with new or existing lifeline systems, such as a portable, temporary horizontal lifeline system.

Accordingly, and in one preferred and non-limiting embodiment, the present invention is directed to a shuttle member for a lifeline system having at least one elongate line attached between at least two anchorage points. The shuttle member includes: a body having: (i) an upper portion configured for attachment to the line by at least partially surrounding the line; (ii) an intermediate portion that, together with the upper portion, defines at least one passage slit; (iii) an attachment portion configured for attachment of at least a portion of an attaching device, and wherein the at least one passage slit is sized such that the elongate line cannot pass therethrough, even under the forces of a fall event.

In a further preferred and non-limiting embodiment, the present invention is utilized in a lifeline system having at least one elongate line attached between at least two anchorage points. In particular, and in this embodiment, the present invention provides a shuttle member passage arrangement, which includes a first shuttle member and a second shuttle member, each having a body with: (i) an upper portion configured for direct or indirect attachment to the line; (i) an intermediate portion that, together with the upper portion, defines at least one passage slit; and (iii) an attachment portion configured for attachment of at least a portion of an attaching device. The first shuttle member is configured to permit at least a portion of the upper portion of the first shuttle member to move through an inner area and passage slit of the second shuttle member from a side thereof, thereby permitting the first shuttle member to pass the second shuttle member.

In a still further preferred and non-limiting embodiment, the present invention is directed to a passing method for a first shuttle member and a second shuttle member in a lifeline system having at least one elongate line attached between at least two anchorage points. The method includes: attaching the first shuttle member and the second shuttle member to the line of the lifeline system; entering at least a portion of the first shuttle member into an inner area of the second shuttle member at a first side thereof; and passing the first shuttle member entirely through the inner area of the second shuttle member, thereby permitting the first shuttle member to pass the second shuttle member.

These and other features and characteristics of the present invention, as well as the methods of operation and functions of the related elements of structures and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention. As used in the specification and the claims, the singular form of "a", "an", and "the" include plural referents unless the context clearly dictates otherwise.

BRIEF DESCRIPTION OF THE DRAWINGS

FIG. 3(*b*) is a schematic view of an intermediate position of the shuttle members of FIG. 3(*a*);

FIG. 3(*c*) is a schematic view of an intermediate passing position of the shuttle members of FIG. 3(*a*);

FIG. 3(*d*) is a schematic view of a further intermediate passing position of the shuttle members of FIG. 3(*a*);

FIG. 3(*e*) is a schematic view of a final passed position of the shuttle members of FIG. 3(*a*);

FIG. 7(*b*) is a side view of the shuttle member of FIG. 7(*a*);

DETAILED DESCRIPTION OF THE PREFERRED EMBODIMENTS

Figure 1:
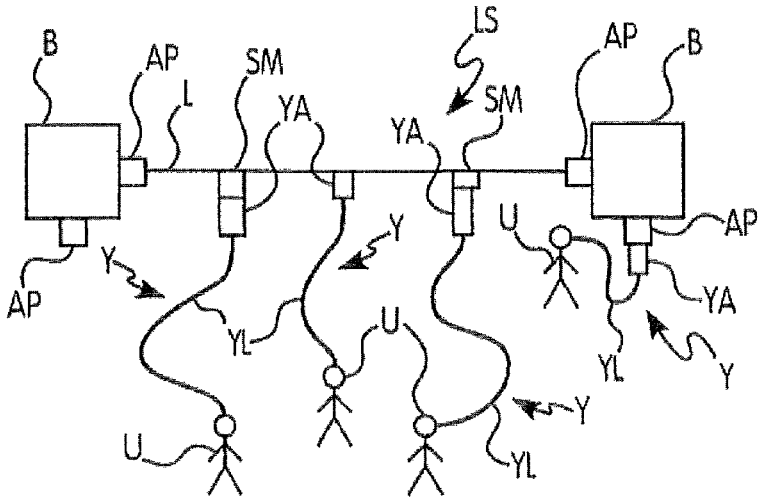
Fig. 1 (Prior Art)
FIG. 1 is a schematic view of a lifeline system according to the prior art.
Figure 2:
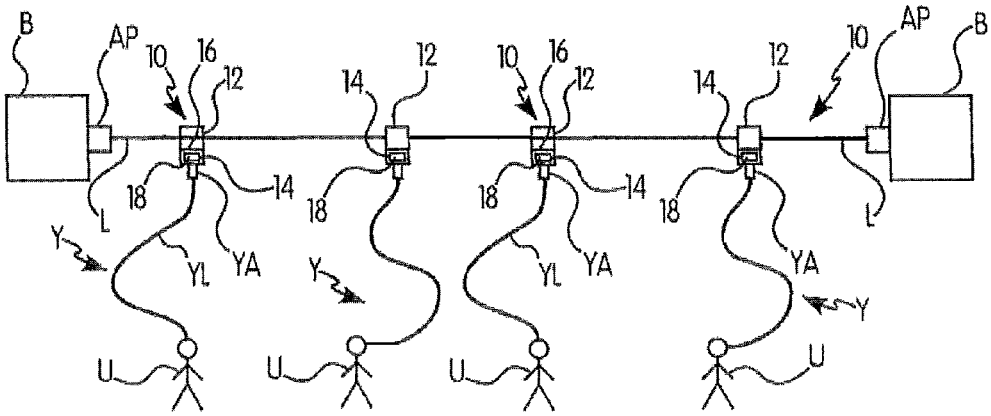
FIG. 2 is a schematic view of one embodiment of a lifeline system according to the principles of the present invention.
Figure 3A:
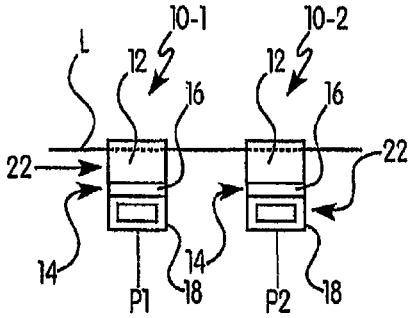
FIG. 3(*a*) is a schematic view of a first position of two shuttle members according to the principles of the present invention.
Figure 3B:
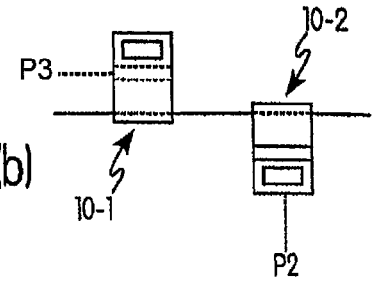
Figure 3C:
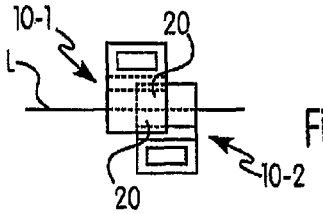
Figure 3D:
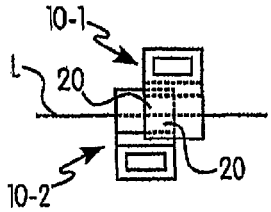
Figure 3E:
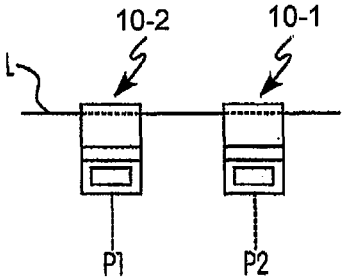

For purposes of the description hereinafter, the terms "end", "upper", "lower", "right", "left", "vertical", "horizontal", "top", "bottom", "lateral", "longitudinal" and derivatives thereof shall relate to the invention as it is oriented in the drawing figures. However, it is to be understood that the invention may assume various alternative variations and step sequences, except where expressly specified to the contrary. It is also to be understood that the specific devices and processes illustrated in the attached drawings, and described in the following specification, are simply exemplary embodiments of the invention. Hence, specific dimensions and other physical characteristics related to the embodiments disclosed herein are not to be considered as limiting. For example, the term "end" may refer to the extreme distal portion or the area near or adjacent that portion. Further, it is to be understood that the invention may assume various alternative variations and step sequences, except where expressly specified to the contrary.

According to the prior art, and as illustrated in FIG. 1, a variety of lifeline systems LS, are known, including the horizontal lifeline system LS shown. In particular, this lifeline system LS includes multiple anchorage points AP attached to or positioned on some part of a sturdy structure, such as a beam B. An elongate line L is attached between two opposing anchorage points AP situated on opposing beams B. It is this line L to which a user U is removably connected or operationally engaged.

In certain known embodiments, the user U attaches a shock-absorbing lanyard Y or other attachment device directly to the line L. This shock-absorbing lanyard Y includes a lanyard line YL that is attached at one end to the user U (normally to a full body harness worn by the user U). At the other end of the lanyard line YL is some lanyard attaching structure YA, normally including a body with a clip or other arrangement for removable attachment to the line L. As also seen in FIG. 1, and as is known in the art, the lanyard attachment structure YA may be attached to a shuttle member SM, which is attached to the line L. This shuttle member SM provides additional and effective functionality by allowing the user U to move easily along the line L in the lifeline systems LS.

However, when two users U need to switch places, the lanyard attaching structure YA must be disconnected from the shuttle members SM and reconnected on the other side of each other, since the shuttle members SM cannot pass each other on the line L. While this mechanical disconnection and reconnection may be simple to accomplish in operation, it is unsafe to perform such an operation at any point along the line L. Instead, both users U must move to one side or the other of the lifeline system LS, such as towards one or the other of the beams B that has the anchorage points AP. At that point, one or both of the users U must disconnect the lanyard Y from the line L, connect it to another anchorage point AP on the beam B and then reconnect after appropriately arranging the positions of the respective lanyards Y to the adjacent shuttle members SM of the users U. As expected, such an operation leads to increased time, decreased efficiency, and a greater possibility of some mishap while the users U are making the switch.

Accordingly, and in one preferred and non-limiting embodiment, the present invention provides a shuttle member 10 for use in connection with the above-discussed lifeline system LS. This shuttle member 10 includes an upper portion 12 that is configured or adapted for attachment to the line L by at least partially surrounding the line L. In addition, an intermediate portion 14, together with the upper portion 12, defines at least one passage slit 16. The passage slit 16 is sized such that the line L cannot pass therethrough, even under the forces generated during a fall event. Further, the shuttle member 10 includes an attachment portion 18 that is adapted or configured for attachment to at least a portion of an attaching device, such as the lanyard attaching structure YA. Of course, any such attaching device that is configured for removable attachment to the shuttle member 10 is envisioned.

The passing operation is illustrated in FIGS. 3(*a*)-3(*e*) and 4. In particular, these drawings illustrate a first shuttle member 10-2 and a second shuttle member 10-2 passing each other. The first shuttle member 10-1 starts in a first position P1, and the second shuttle member 10-2 starts in a second position P2. In this example, the user of the first shuttle member 10-1 wishes to pass the user of the second shuttle member 10-2 in order to accomplish some task at the other end of the lifeline system LS.

FIG. 3(*a*) shows the first shuttle member 10-1 and second shuttle member 10-2 in their original positions P1, P2 respectively. As a first step in this preferred and non-limiting embodiment, the first shuttle member 10-1 is rotated (approximately 180°) with respect to the second shuttle member 10-2. Specifically, the first shuttle member 10-1 is rotated or moved from the first position P1 to a third position P3. See FIG. 3(*b*).

Next, and as illustrated in FIGS. 3(*c*) and 3(*d*), at least a portion of the first shuttle member 10-1 is moved into an inner area 20 of the second shuttle member 10-2 (which also means that a portion of the second shuttle member 10-2 would be positioned within the inner area 20 of the first shuttle member 10-1. In any case, this positioning and movement into the inner area 20 is accomplished through the positioning and alignment of the passage slits 16 of each shuttle member 10-1, 10-2. In particular, bodies 22 of each shuttle member 10-1, 10-2 are moved through and along the passage slit 16 of the other shuttle member 10-1, 10-2. Once the passage is completed, and as illustrated in FIG. 3(*e*), the first shuttle member 10-1 is rotated or moved back to its original orientation, with the result being that the first shuttle member 10-1 is now in the second position P2, and the second shuttle member 10-2 is in the first position P1.

Figure 4:
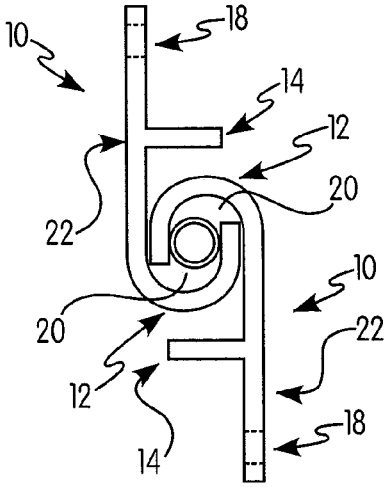
FIG. 4 is a side sectional view of two shuttle members according to the principles of the present invention in a passing position.

Importantly, during this passage operation, and as illustrated in FIG. 4, the shuttle members 10-1, 10-2 remain in an attached or connected position with respect to the line L of the lifeline system LS. Specifically, the line L is still at least partially surrounded by each of the upper portions 12 of the shuttle members 10-1, 10-2, i.e., the line L is located at least partially within the inner area 20 of each shuttle member 10-1, 10-2. Accordingly, both users remain safely connected to the line L in the lifeline system LS during passage, such that, in the event of a fall, the shuttle member 10 (and the attaching device for lanyard Y) are still effective in the necessary fall arrest function.

In order to accomplish this passing operation, the present invention provides various preferred and non-limiting structures and arrangements, as illustrated in FIGS. 5-16. Each of these various preferred and non-limiting embodiments of the shuttle member 10 will be discussed hereinafter.

Figure 5:
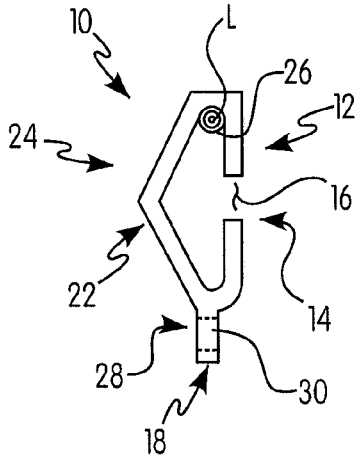
FIG. 5 is a side view of one embodiment of a shuttle member according to the principles of the present invention.

With reference to FIG. 5, and in this preferred and non-limiting embodiment, the upper portion 12 and the intermediate portion 14 form a substantially C-shaped structure 24 that defines the passage slit 16. The passage slit 16 is sized such that the line L cannot pass therethrough, even under the forces generated by a fall. In further embodiments, a roller (not shown) can be operationally engaged with or within the upper portion 12 of the shuttle member 10 for use in contacting the line L during normal operation of the shuttle member 10. However, in certain instances and environments, the use of an additional mechanical structure, e.g., a roller, is not optimal. Instead, the upper portion 12 includes an inner surface 26 that is adapted, configured, sized, and/or shaped to contact the line L. In this manner, the shuttle member 10 glides along the line L. Still further, and in order to enhance this sliding or gliding function, at least a portion of the inner surface 26 of the upper portion 12 can be smooth, rounded, shaped, coated, or the like. Such configurations and arrangements are used to decrease friction, thereby increasing the user's ability to effectively function while attached to the lifeline system LS.

As also illustrated in FIG. 5, the attachment portion 18 of the shuttle member 10 is in the form of an extension 28 extending from the intermediate portion 14. In addition, this extension 28 includes an opening 30 that is sized and shaped so as to permit connection of an attaching portion (e.g., the lanyard attaching structure YA) thereto.

Figure 6:
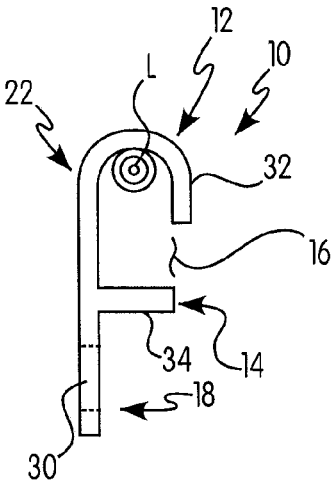
FIG. 6 is a side view of another embodiment of a shuttle member according to the principles of the present invention.

A further preferred and non-limiting embodiment is illustrated in FIG. 6. In this embodiment, the upper portion 12 is in the form of a hook 32, and the intermediate portion 14 is in the form of an extending tongue 34. Accordingly, the hook 32 and the extending tongue 34 together define the passage slit 16. The passage slit 16 is smaller than the diameter of the line L. This embodiment also uses the extension 28 and opening 30 discussed above.

Figure 7B:
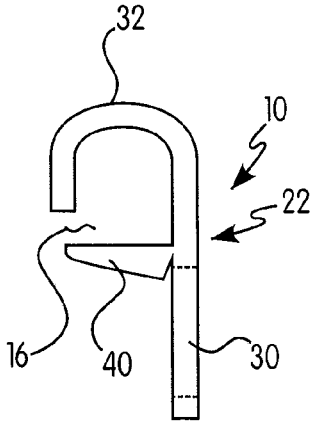
FIG. 7(*a*) is a front view of a further embodiment of a shuttle member according to the principles of the present invention.
Figure 7A:
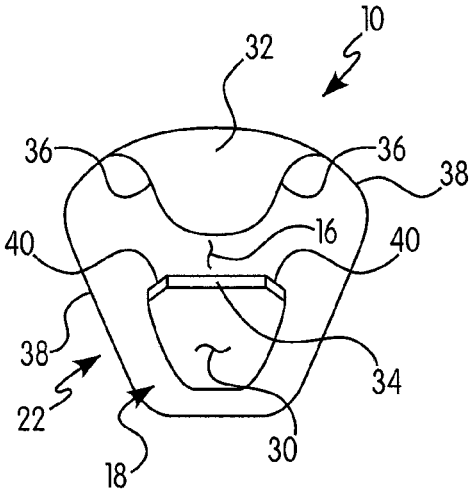

A further embodiment is illustrated in FIG. 7(*a*)-7(*b*). In this embodiment, the hook 32 and extending tongue 34 are utilized. In addition, and as best seen in FIG. 7(*a*), the hook 32 includes rounded or contoured edges 36, and the body 22 includes tapered (or angled) edges 38. With reference to FIG. 7(*b*), the extending tongue 34 also includes certain edges 40 that are tapered or angled.

By using the rounded, tapered, angled, shaped, or the like, edges on the body 22, the upper portion 12, and/or the extending tongue 34, appropriate orientation and alignment is structurally urged after rotation for passage. In particular, based upon the shaped surfaces, edges, and sides, it is easier to quickly and effectively locate and begin entry between the shuttle members 10 via their respective passage slits 16. For example, and based upon the contour or shape of the body edges 38 and hook edges 36, when contacting the tongue edge 40 (and based upon the tapered or angled nature of the edge 40), the body 22 slides along and is urged into the passage slit 16. Of course, other variations and shapes to provide such an "urging" or alignment function are envisioned.

In addition, the shapes and contours of the upper portion 12, intermediate portion 14, passage slit 16, and/or body 22 can be configured, sized, and/or shaped so as to begin to urge or fully urge the first shuttle member 10-1 to a rotated position with respect to the second shuttle member 10-2, such that they are aligned for passage. Accordingly, in some embodiments, the body 22 (or any portions thereof) can be specifically configured to allow for rotation and passage upon contact without the need for user interaction, or with minimal interaction. In other embodiments, the size and shape of the body 22 (or portions thereof) are designed and configured to only begin to urge the shuttle members 10 to the appropriate positions, but require final manual positioning and passage by one or both of the users.

Figure 8:
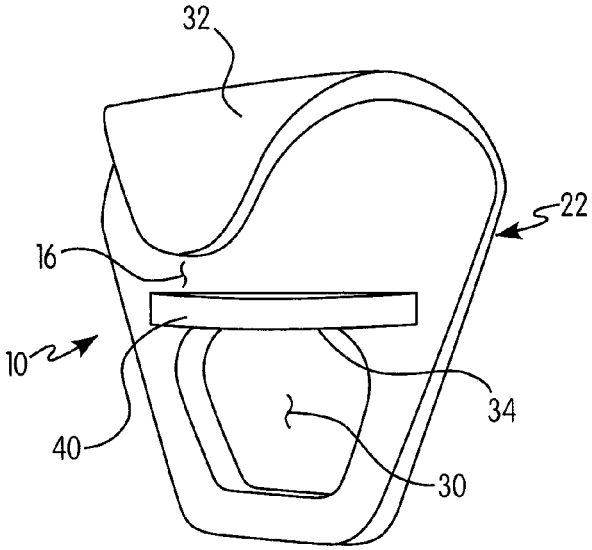
FIG. 8 is a perspective view of another embodiment of a shuttle member according to the principles of the present invention.

A further preferred and non-limiting embodiment is illustrated in FIG. 8. In this embodiment, the above-discussed shaped hook 32 and body 22 are used. However, in this embodiment, the edges 40 of the extending tongue 34 are formed such that the tongue 34 is in a substantially semi-circular shape (when viewed from above). Further, in this embodiment, the extending tongue 34 is a substantially flat member when viewed from the front. Again, by the use of the semi-circular shape of the extending tongue 34, together with the other shaped edges and surfaces of the shuttle member 10, easier orientation and passage is achieved.

Figure 9:
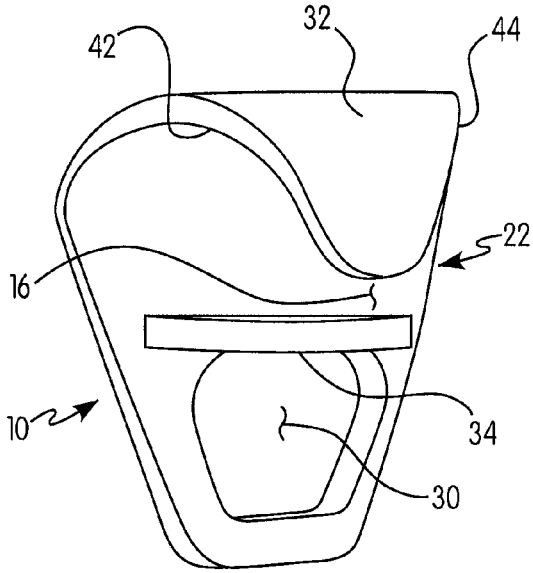
FIG. 9 is a perspective view of a further embodiment of a shuttle member according to the principles of the present invention.

A similar arrangement is illustrated in FIG. 9. However, in the preferred and non-limiting embodiment of FIG. 9, the hook 32 is offset, such that a first side edge 42 of the hook 32 has a longer dimension than a second side edge 44 of the hook 32. This provides additional rotation properties, and may also lend to further structural and strength advantages.

Figure 10:
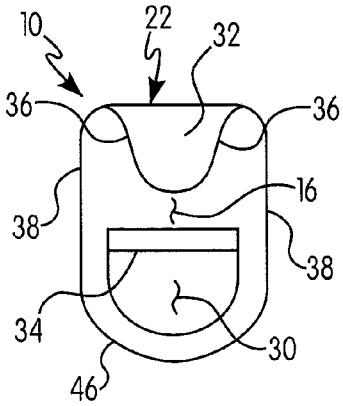
FIG. 10 is a front view of a still further embodiment of a shuttle member according to the principles of the present invention.

In the preferred and non-limiting embodiment of FIG. 10, the body 22 is in a substantially U-shaped structure, where the bottom edge 46 of the body 22 is rounded. Similarly, the opening 30 in the extension 28 of the attachment portion 18 is likewise rounded. The rounded shape of the opening 30 allows for greater movement and angular variation between the attaching structure YA of the lanyard Y and the shuttle member 10 during operation and use thereof.

Figure 11:
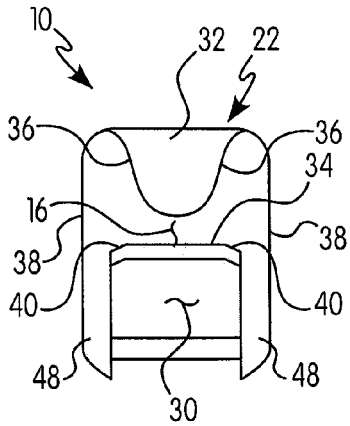
FIG. 11 is a front view of another embodiment of a shuttle member according to the principles of the present invention.

In the preferred and non-limiting embodiment of FIG. 11, the hook 32 and extending tongue 34 are similar in contour and shape as that of the embodiment of FIGS. 7(*a*)-7(*b*). However, in this embodiment, the edges 38 of the body 22 are substantially straight. Further, this embodiment includes guard members 48 extending from these side edges 38 near a bottom area thereof. In particular, these guard members 48 are positioned substantially adjacent the opening 30, and further, these guard members 48 taper inward. Based upon the position, orientation, and shape of these guard members 48, the lanyard attaching structure YA that is attached to the opening 30 is protected when and if two shuttle members 10 contact each other. Such an arrangement would prevent inadvertent detachment of the lanyard Y (or attaching device) from the shuttle member 10, and thus the lifeline system LS.

Figure 12:
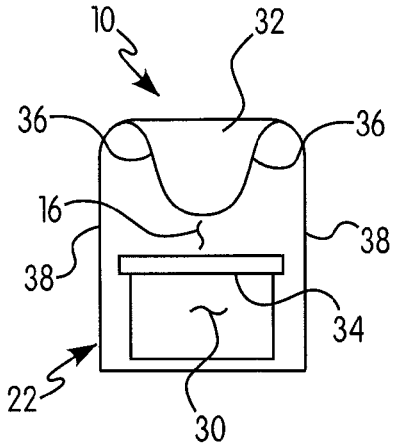
FIG. 12 is a front view of another embodiment of a shuttle member according to the principles of the present invention.

A still further preferred and non-limiting embodiment of the shuttle member 10 according to the present invention is illustrated in FIG. 12. In this embodiment, the body 22 is a substantially square-shaped structure, and the opening 30 is likewise in a square-shaped form. In addition, the hook 32 has a flatter, wider shape than the embodiments of FIGS. 7-11.

Figure 13:
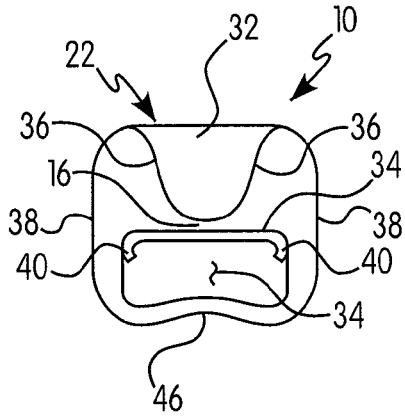
FIG. 13 is a front view of a further embodiment of a shuttle member according to the principles of the present invention.

With respect to the preferred and non-limiting embodiment of FIG. 13, the extending tongue 34 includes edges 40 that are curved downward in a similar manner as the angled edges 40 of the extending tongue 34 of the embodiments in FIGS. 7 and 11. In addition, the opening 30, as well as the bordering bottom edge 46 of the body 22 are curved so as to provide multiple curved surfaces. Such an arrangement would assist in directing the lanyard attaching structure YA over this curved area as the user moves back and forth along the line L of the lifeline system LS.

Figure 14:
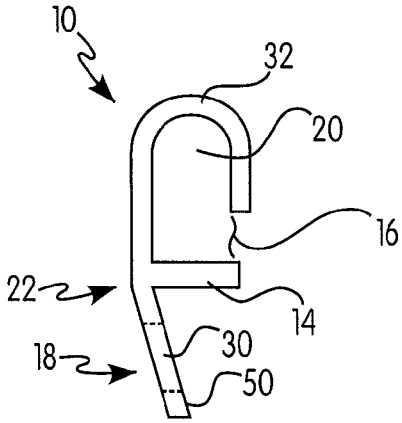
FIG. 14 is a side view of a further embodiment of a shuttle member according to the principles of the present invention.

In yet another preferred and non-limiting embodiment, and as illustrated in FIG. 14, the front surface 50 of a portion of the body 22, such as the extension 28 (or bottom portion of the body 22), may be tapered or angled. By tapering or angling the attachment portion 18, a different extension angle is applied to the lanyard attaching structure YA and, thus, the lanyard Y. Again, this may assist in facilitating easier movement along the line L of the lifeline system LS.

Figure 15:
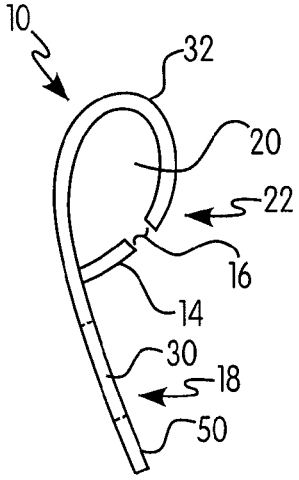
FIG. 15 is a side view of a still further embodiment of a shuttle member according to the principles of the present invention.
Figure 16:
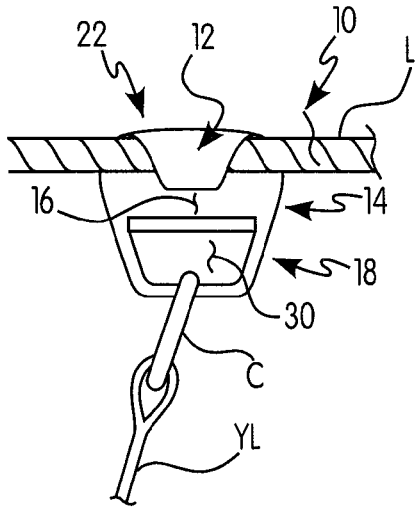
FIG. 16 is a front view of another embodiment of a shuttle member according to the principles of the present invention as attached to a lifeline system.

Similarly, the front surface 50 of the attachment portion 18 can be curved, as illustrated in the preferred and non-limiting embodiment of FIG. 15. In addition, in this embodiment, the extending tongue 34 is also curved upwards towards the hook 32. Such an arrangement allows for efficient and effective passing of the shuttle members 10 while still ensuring that both shuttle members 10 remain attached to the line L.

The material used to make the shuttle member 10, as is known by one skilled in the art, can be chosen based upon the strength requirements, the size, shape and type of line L, and/or the environment in which the user U is utilizing the shuttle member 10. For example, the shuttle member may be formed in whole or in part from a metal, a semi-metal, a powdered metal, a synthetic material, a stamped material, a molded material, or the like. Any suitable material of construction is envisioned.

In use, and as discussed above, the shuttle member 10 is attached to the line L in the lifeline system LS. The lanyard attaching structure YA is then attached or connected to the opening 30, i.e., the attachment portion 18. In the preferred and non-limiting embodiment of FIG. 16, the lanyard attaching structure YA includes a clip or carabiner C that is removably attachable through the opening 30. The lanyard line YL is permanently attached to the clip C, such as through the use of connecting loops on the clip C and the lanyard line YL.

In this manner, the present invention provides a method, apparatus, and arrangement for use in connection with a lifeline system LS that allows for the safe passage of users U using lanyard attaching devices Y, which are attached to the shuttle member 10. By using the presently-invented methods, apparatus, and arrangements, safe passage is permitted without the time constraints of known arrangements, and without diminishing the worker's safety. While the present invention can be used with any type or style of lifeline system (whether horizontal or vertical, existing or new, temporary or permanent), the present invention is particularly useful in connection with a portable, temporary horizontal lifeline system LS.

Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of the appended claims. For example, it is to be understood that the present invention contemplates that, to the extent possible, one or more features of any embodiment can be combined with one or more features of any other embodiment.

What is claimed is:

1. In a lifeline system having at least one elongate line attached between at least two anchorage points, a shuttle member passage arrangement comprising:

a first shuttle member and a second shuttle member, each movable along the elongate line, and each comprising a body having: (i) an upper portion configured for direct or indirect attachment to the line; (ii) an intermediate portion that, together with the upper portion, defines at least one passage slit that is sized such that the elongate line cannot pass therethrough when the shuttle member upper portion is in contact with the elongate line; and (iii) an attachment portion configured for attachment of at least a portion of an attaching device;

wherein the first shuttle member is configured to permit at least a portion of the upper portion of the first shuttle member to move through an inner area and passage slit of the second shuttle member from a side thereof, thereby permitting the first shuttle member to pass the second shuttle member.

2. The system of claim 1, wherein the upper portion and the intermediate portion of at least one shuttle member form a substantially C-shaped structure defining the passage slit.

3. The system of claim 1, wherein the upper portion of at least one shuttle member is in the form of a hook configured to at least partially surround the line of the lifeline system, and the intermediate portion of at least one shuttle member is in the form of an extending tongue.

4. The system of claim 1, wherein at least one of the following of at least one shuttle member: at least a portion of at least one side edge of the body, at least a portion of at least one side edge of the upper portion, at least a portion of at least one side edge of the intermediate portion, at least a portion of at least one side edge of the attachment portion, or any combination thereof, is at least one of the following: tapered, angled, pointed, rounded, shaped, or any combination thereof.

5. The system of claim 1, wherein at least one side edge of the body of one shuttle member is shaped so as to urge the shuttle member from a first position to a second position with respect to an adjacent shuttle member.

6. The system of claim 1, wherein the intermediate portion of at least one shuttle member is in the form of an extending tongue.

7. The system of claim 1, wherein the attachment portion of at least one shuttle member defines an opening extending through the body of the shuttle member, and wherein the opening is sized and shaped so as to permit connection of an attaching device to the attachment portion.

8. The system of claim 1, further comprising one or more additional shuttle members attached to the line of lifeline system.

9. The system of claim 5, wherein the second position is a position of orientation of up to about 180° with respect to the first position.

10. The system of claim 6, wherein at least a portion of at least one side edge of the extending tongue is at least one of the following: tapered, angled, pointed, rounded, shaped, or any combination thereof.

11. The system of claim 1, wherein at least a portion of the first and second shuttle members is formed from at least one of the following: a metal, a semi-metal, an alloy, a powdered metal, a synthetic material, a stamped material, a molded material, or any combination thereof.

12. The system of claim 1, wherein the first shuttle member and the second shuttle member are connected to the elongate line when the first shuttle member passes the second shuttle member.

13. The system of claim 1, wherein the upper portion of at least one shuttle member further comprises an inner surface that is configured to enhance gliding or sliding of the at least one shuttle member on the elongate line.

14. The system of claim 13, wherein the inner surface is at least one of the following: smooth, rounded, shaped, coated, or any combination thereof.

15. The system of claim 1, wherein at least one shuttle member further comprises at least one guard member extending from the attachment portion to prevent inadvertent detachment of the attaching device.

16. A passing method for a lifeline system, the lifeline system having at least one elongate line attached between at least two anchorage points, a shuttle member passage arrangement comprising: a first shuttle member and a second shuttle member, each movable along the elongate line, and each comprising a body having: (i) an upper portion configured for direct or indirect attachment to the line; (ii) an intermediate portion that, together with the upper portion, defines at least one passage slit that is sized such that the elongate line cannot pass therethrough when the shuttle member upper portion is in contact with the elongate line; and (iii) an attachment portion configured for attachment of at least a portion of an attaching device; wherein the first shuttle member is configured to permit at least a portion of the upper portion of the first shuttle member to move through an inner area and passage slit of the second shuttle member from a side thereof, thereby permitting the first shuttle member to pass the second shuttle member; wherein the method comprises:

entering at least a portion of the first shuttle member into an inner area of the second shuttle member at a first side thereof; and passing the first shuttle member entirely through the inner area of the second shuttle member, thereby permitting the first shuttle member to pass the second shuttle member.

17. The method of claim 16, wherein, prior to the entering step, the method further comprises rotating the first shuttle member from a first position to a second position with respect to the second shuttle member.

18. The method of claim 17, wherein the second position is a position of orientation of up to about 180° with respect to the first position.

19. The method of claim 17, wherein, after the passing step, the method further comprises rotating the first shuttle member from the second position to the first position with respect to the second shuttle member.

20. The method of claim 16, wherein the first shuttle member and the second shuttle member are connected to the elongate line during the passing step.

* * * * *